US010594074B1

(12) United States Patent
Zhao et al.

(10) Patent No.: US 10,594,074 B1
(45) Date of Patent: Mar. 17, 2020

(54) SHIELDED MAGNETIC ELECTRONIC CONNECTOR

(71) Applicant: Microsoft Technology Licensing, LLC, Redmond, WA (US)

(72) Inventors: Tianyu Zhao, Kirkland, WA (US); Aseem Singla, Bothell, WA (US); Le Chang, Kirkland, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/175,513

(22) Filed: Oct. 30, 2018

(51) Int. Cl.
*H01R 13/62* (2006.01)
*H01R 13/6581* (2011.01)
*H01R 12/79* (2011.01)
*H01R 12/77* (2011.01)

(52) U.S. Cl.
CPC ..... *H01R 13/6205* (2013.01); *H01R 12/775* (2013.01); *H01R 12/79* (2013.01); *H01R 13/6581* (2013.01)

(58) Field of Classification Search
CPC ..... H01R 12/62; H01R 12/79; H01R 12/592; H01R 9/096; H01R 13/6205; H01R 13/658; H01R 11/30; H01R 23/725; H01R 23/662; H01R 12/775; H01R 13/6581
USPC ..... 439/39, 74, 67, 492, 497
See application file for complete search history.

(56) References Cited

U.S. PATENT DOCUMENTS 5,863,211 A * 1/1999 Sobotta ..... G06F 1/184 439/74
6,077,121 A * 6/2000 Wu ..... H01R 12/712 439/607.05
6,761,573 B1 7/2004 Chiu
7,207,842 B1 * 4/2007 Kenjo ..... H01R 9/0515 439/607.01
7,585,185 B2 * 9/2009 Obikane ..... H01R 12/52 439/607.01
8,192,219 B2 6/2012 Satoh
(Continued)

FOREIGN PATENT DOCUMENTS

CN 102810775 A 12/2012
CN 105896128 A 8/2016

OTHER PUBLICATIONS

"I-PEX Board-to-Board (FPC) connector NOVASTACK4", Retrieved from: https://web.archive.org/web/20170216120958/https:/www.i-pex.com/Products/detail/8, Feb. 16, 2017, 2 Pages.

*Primary Examiner* — Gary F Paumen
(74) *Attorney, Agent, or Firm* — Arent Fox LLP

(57) ABSTRACT

An electronic connector assembly includes a first PCB including a first electrical circuit, and a connector member disposed on a first side of the first PCB and electrically connected to the first electrical circuit. The connector member has a connector body sized to fit within an opening defined by walls of an EMI shield frame. The electronic connector assembly further includes a permanent magnet disposed on a second side of the first PCB. The permanent magnet has a magnet body sized to cover the opening in the EMI shield frame of a receptacle assembly and to provide a magnetic attraction force between the permanent magnet and the EMI shield frame to press the first PCB against an opposing portion of the walls of the EMI shield frame and cause a grounded portion of the first side of the first PCB to make an electrical connection with the EMI shield frame.

20 Claims, 4 Drawing Sheets

(56) References Cited

U.S. PATENT DOCUMENTS

| | | | | |
|---|---|---|---|---|
| 8,197,285 | B2 * | 6/2012 | Farmer | H01R 12/712 439/607.3 |
| 8,813,354 | B2 | 8/2014 | Wu | |
| 9,325,107 | B2 * | 4/2016 | Karls | H01R 13/6205 |
| 9,548,559 | B2 * | 1/2017 | Zhou | H01R 13/6205 |
| 9,614,321 | B2 * | 4/2017 | Nakamura | H01R 13/6205 |
| 2005/0101163 | A1 * | 5/2005 | Obikane | H01R 13/6471 439/74 |
| 2005/0282412 | A1 * | 12/2005 | Asai | H01R 13/6594 439/74 |
| 2009/0081893 | A1 * | 3/2009 | Bae | H04B 1/3833 439/74 |
| 2015/0194753 | A1 * | 7/2015 | Raff | H01R 12/716 439/75 |
| 2016/0353616 | A1 | 12/2016 | Dinh et al. | |

* cited by examiner

SHIELDED MAGNETIC ELECTRONIC CONNECTOR

BACKGROUND

The present disclosure relates generally to electronic connectors, and more particularly, to shielded electronic connectors.

Generally, a circuit board, such as a Printed Circuit Board (PCB) or a Flexible Printed Circuit (FPC), may exchange electrical power, ground reference, and/or communication signals with another electronic board through a hardware interface such as an electronic connector. A typical electronic connector includes a connector assembly configured to engage a corresponding receptacle assembly. There may be issues with maintaining the connection between the connector assembly and the receptacle assembly, such as in cases where the electronic connector is subject to vibration or other external mechanical forces. There have been attempts to address the aforementioned issues with maintaining the connection (e.g., by adding a separate component or enclosure/screen), however, they may not be satisfactory as they add cost, increase complexity, or require additional space.

Generally, an electronic connector may be enclosed within an Electro-Magnetic Interference (EMI) shield, such as an EMI shield can, to prevent interference to nearby circuits and/or antennas. However, EMI shield cans are often damaged when the top wall is opened/removed.

Accordingly, more practical, space-efficient, and cost-effective EMI-shielded electronic connectors are needed.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

Embodiments provide an electronic connector assembly. In an aspect, the electronic connector assembly includes a first printed circuit board (PCB) including a first electrical circuit and a first connector member disposed on a first side of the first PCB and electrically connected to the first electrical circuit. The first connector member has a connector body sized to fit within an opening defined by walls of an electromagnetic interference (EMI) shield frame comprising a magnetically-attractive material. In an aspect, the electronic connector assembly further includes a permanent magnet disposed on a second side of the first PCB opposite the first side. The permanent magnet has a magnet body sized to cover the opening in the EMI shield frame of a receptacle assembly. The magnet body is sized to provide a magnetic attraction force between the permanent magnet and the EMI shield frame to press the first PCB against an opposing portion of the walls of the EMI shield frame and cause a grounded portion of the first side of the first PCB to make an electrical connection with the EMI shield frame.

In another aspect, an electronic connector is provided. The electronic connector includes an electronic connector assembly including a first PCB having a first electrical circuit, a first connector member disposed on a first side of the first PCB and electrically connected to the first electrical circuit, and a permanent magnet disposed on a second side of the first PCB opposite the first side. The electronic connector further includes a receptacle assembly comprising an EMI shield frame disposed on a second PCB and electrically connected to a grounded portion of the second PCB, and a second connector member mounted to the second PCB within the EMI shield frame and electrically connected to a second electrical circuit on the second PCB, where the second connector member is configured to engage the first connector member to connect the first electrical circuit with the second electrical circuit. The first connector member has a connector body sized to fit within an opening defined by walls of the EMI shield frame. The EMI shield frame includes a magnetically-attractive material, and the permanent magnet has a magnet body sized to cover the opening in the EMI shield frame and to provide a magnetic attraction force between the permanent magnet and the EMI shield frame to press the first PCB against an opposing portion of the walls of the EMI shield frame and cause a grounded portion of the first side of the first PCB to make an electrical connection with the EMI shield frame.

In yet another aspect, an electronic connector kit is provided. The electronic connector kit includes an electronic connector assembly including a first PCB having a first electrical circuit; a first connector member configured to be mounted on a first side of the first PCB and to be electrically connected to the first electrical circuit; and a permanent magnet attachable on a second side of the first PCB opposite the first side. The electronic connector kit further includes a receptacle assembly including a second PCB; an EMI shield frame configured to be mounted on the second PCB and to be electrically connected to a grounded portion of the second PCB; and a second connector member configured to be mounted to the second PCB within the EMI shield frame and to be electrically connected to a second electrical circuit on the second PCB. The second connector member is configured to engage the first connector member to connect the first electrical circuit with the second electrical circuit. The first connector member has a connector body sized to fit within an opening defined by walls of the EMI shield frame. The EMI shield frame includes a magnetically-attractive material; and the permanent magnet has a magnet body sized to cover the opening in the EMI shield frame and to provide a magnetic attraction force between the permanent magnet and the EMI shield frame to press the first PCB against an opposing portion of the walls of the EMI shield frame and cause a grounded portion of the first side of the first PCB to make an electrical connection with the EMI shield frame.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

Figure 2:
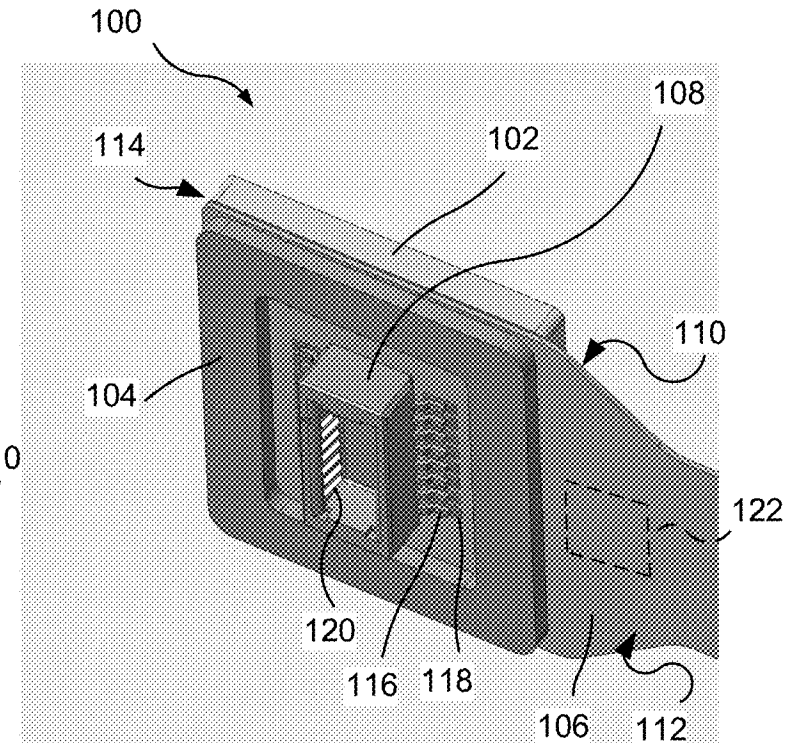
FIG. 2 is a bottom perspective view of the example electronic connector assembly of FIG. 1.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components may be shown in block diagram form in order to avoid obscuring such concepts.

Aspects of the present disclosure include an electronic connector having a permanent magnet affixed on an electronic connector assembly, where the permanent magnet not only supplements the retention force that keeps the electronic connector assembly engaged with a corresponding receptacle assembly, but also enables or completes an Electro-Magnetic Interference (EMI) shield by causing a grounded portion of the electronic connector assembly to make electrical contact with a top portion of an open, electrically conductive shield frame on the receptacle assembly so as to form an EMI-protected space. Accordingly, the supplemental retention force provided by the permanent magnet eliminates the need for a separate component or enclosure/screen to press on the electronic connector. Further, pressing the electronic connector assembly against the shield frame completes a top wall and encloses the EMI-protected space, eliminating the need for a separate EMI protection enclosure such as an EMI shield can. As a result of the above, a more cost-effective and space-effective electronic connector is provided by the present aspects.

Generally, some electronic connector assemblies may be configured with an EMI shield that prevents interference to nearby circuits and/or antennas, e.g., a Wireless Fidelity (Wi-Fi), cellular, and/or BLUETOOTH™ antenna of the device that implements the electronic connector. Such an EMI shield may also be referred to as a radio frequency (RF) shield. As an example, an EMI shield may include an EMI shield can, which may be a rectangular- or square-shaped metal enclosure having side walls connected to a top wall, and which is electrically mounted to a circuit board and covers an electronic component such as the electronic connector. The EMI shield cans are often damaged when the top wall is opened/removed in order to repair the electronic connector or other electrical components enclosed within the EMI shield can. As such, many EMI shield cans are not appropriate for implementations where there is a need for occasional opening/removal of the EMI shield from the electronic connector to provide access to the electronic connector. Further, such EMI shield cans add to the cost of the repair as they need to be reworked or replaced.

However, unlike electronic connectors that require EMI shield cans that cannot be easily repaired, the presently disclosed electronic connector assembly may be disengaged from and then re-engaged with the receptacle assembly without being damaged. Accordingly, the presently disclosed electronic connector assembly is therefore suitable for implementations where there is a need for occasional opening/removal of the EMI shield from the electronic connector to provide access to the electronic connector, e.g., for disassembly of a device, modification of a circuit, testing, troubleshooting, upgrade, etc. The electronic connector of this disclosure may be particularly well-suited for use as a board-to-board (B2B) connector.

Turning now to the figures, example aspects are depicted with reference to one or more components described herein, where components in dashed lines may be optional. In the following, FIGS. 1-5, which may include similar or related components, are described with reference to each other.

Figure 1:
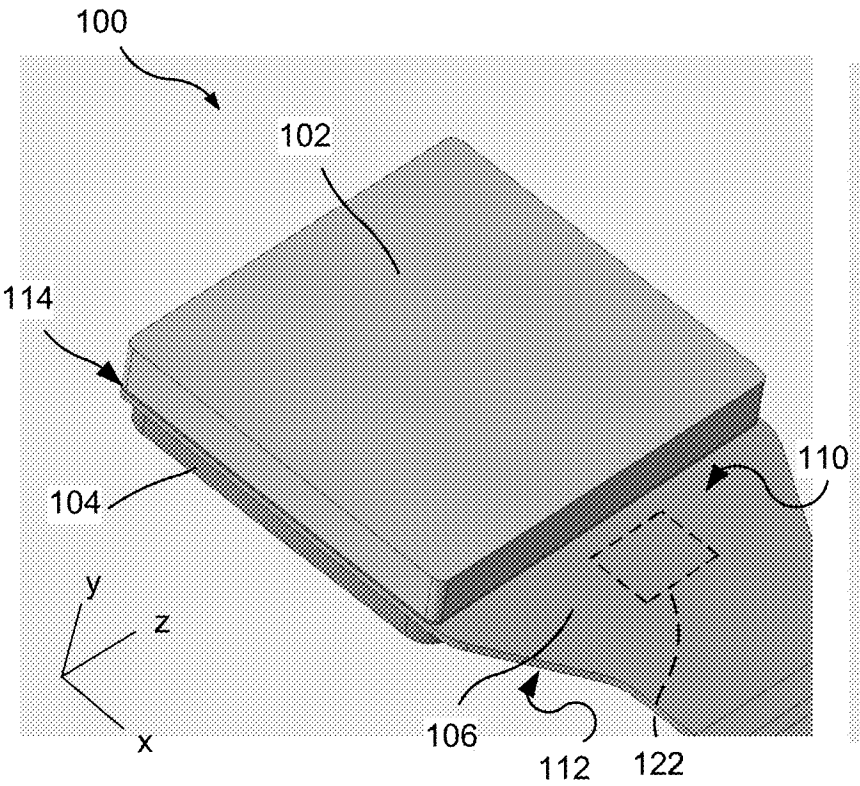
FIG. 1 is a top perspective view of an example electronic connector assembly including at least a first connector member.
Figure 3:
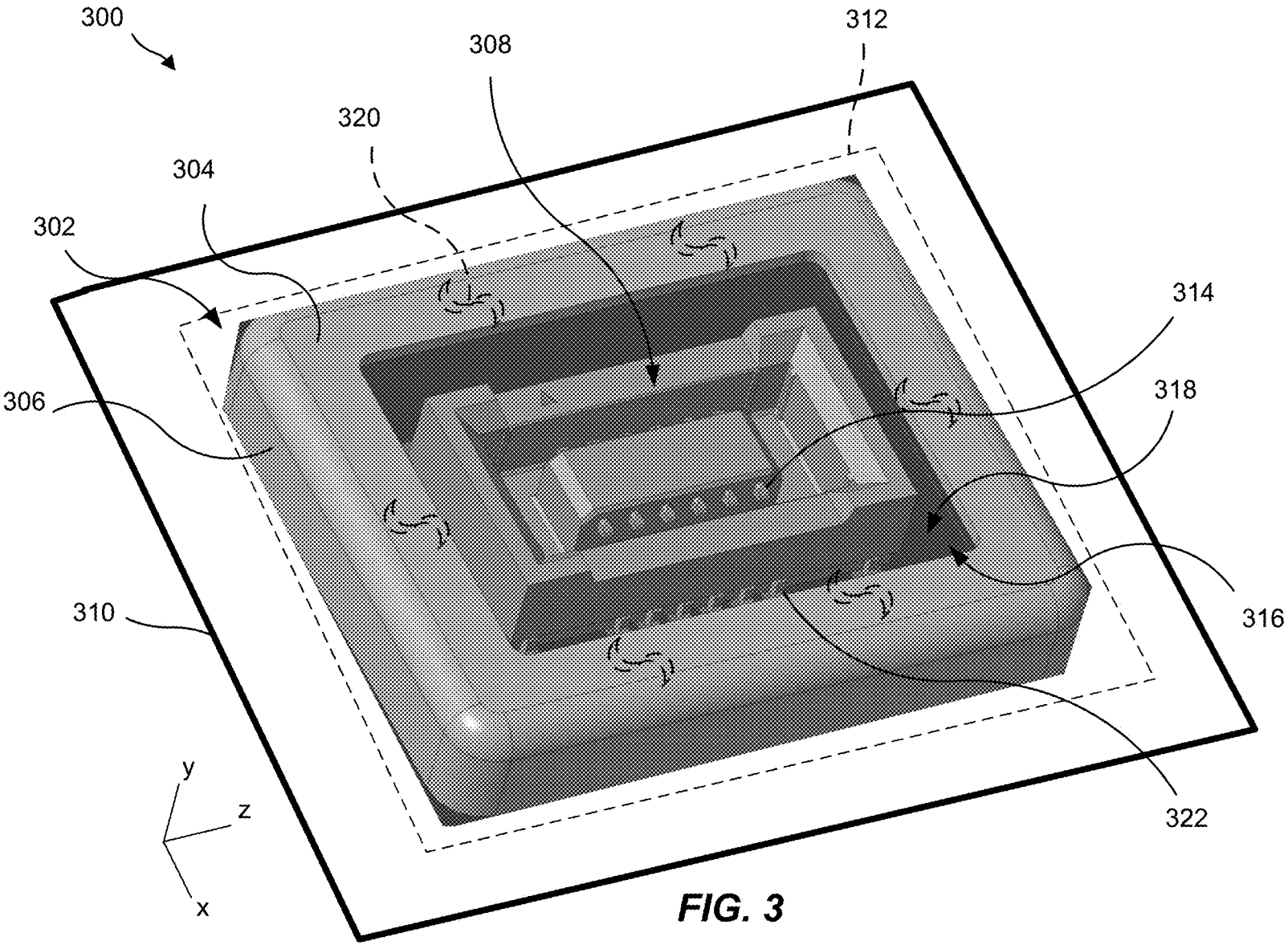
FIG. 3 is a top perspective view of an example receptacle assembly, which may be a part of the example electronic connector assembly of FIG. 1, where the receptacle assembly is mounted to a circuit board and configured for engaging the first connector member of FIG. 1.
Figure 4:
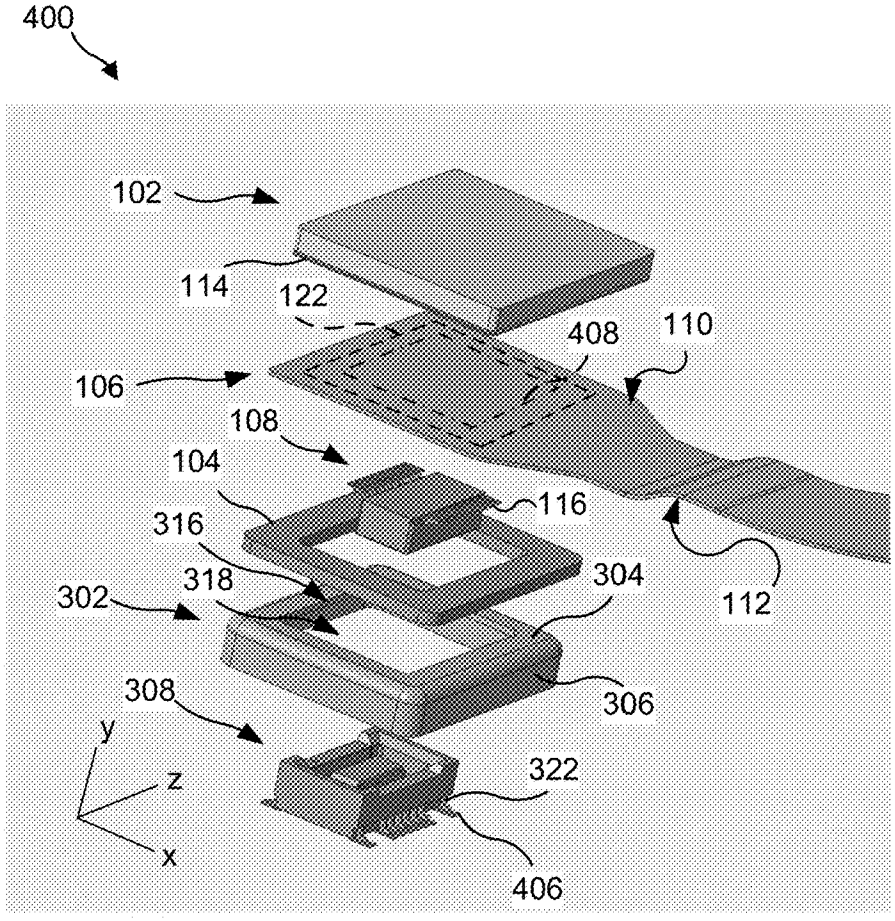
FIG. 4 is an exploded top perspective view of components of the example electronic connector assembly of FIGS. 1, 2, and 3.

Referring to FIGS. 1 and 2, one example of an electronic connector assembly 100 includes at least a first connector member 108 (see FIG. 2) attached to a first side 112 (FIG. 2) of a first Printed Circuit Board (PCB) 106 and a permanent magnet 102 attached to a second side 110 of the first PCB 106, such that the permanent magnet 102 enhances electrical contact of the first PCB 106 with an adjoining EMI shield and/or biases the first connector member 108 to remain connected to a corresponding connector member (as will be discussed below in more detail with reference to FIGS. 3 and 4). The first connector member 108 may be a male or female electrical connector, such as but not limited to an electrical B2B plug. The first PCB 106, which may be but is not limited to a Flexible Printed Circuit (FPC), includes a first electrical circuit 122 to which the first connector member 108 is electrically connected, for example, through one or more electrically conductive first contact legs 116 extending from the first connector member 108. For instance, the one or more electrically conductive first contact legs 116 may be soldered, surface mounted, or otherwise electrically attached to one or more electrically conductive first contact plates 118 defined on the first side 112 of the first PCB 106. For example, the one or more electrically conductive first contact plates 118 may be electrically connected to the first electrical circuit 122, on the first PCB 106. The first connector member 108 may further include first electrical contacts 120 that are electrically connected to respective ones of the first contact legs 116 and that are further alignable with corresponding electrical contacts of a mating connector (as described below with reference to FIGS. 3 and 4). For example, in an implementation, the first electrical contacts 120 may be positioned on a body of the first connector member 108, such as on an internal or external surface that comes into contact with or otherwise mates with the corresponding electrical contacts of the mating connector.

Optionally, in some implementations, the electronic connector assembly 100 may further include an adhesive layer 114 between the permanent magnet 102 and the second side 110 of the first PCB 106. Additional details regarding the adhesive layer 114 are further described below with reference to FIGS. 4 and 5. In another optional or additional implementation, which may be used with or without the adhesive layer 114, the electronic connector assembly 100 may further include an electrically conductive deformable ring 104 that is electrically connected to a ground on the first side 112 of the first PCB 106. Additional details regarding the electrically conductive deformable ring 104 are further described below with reference to FIGS. 4 and 5.

Figure 5:
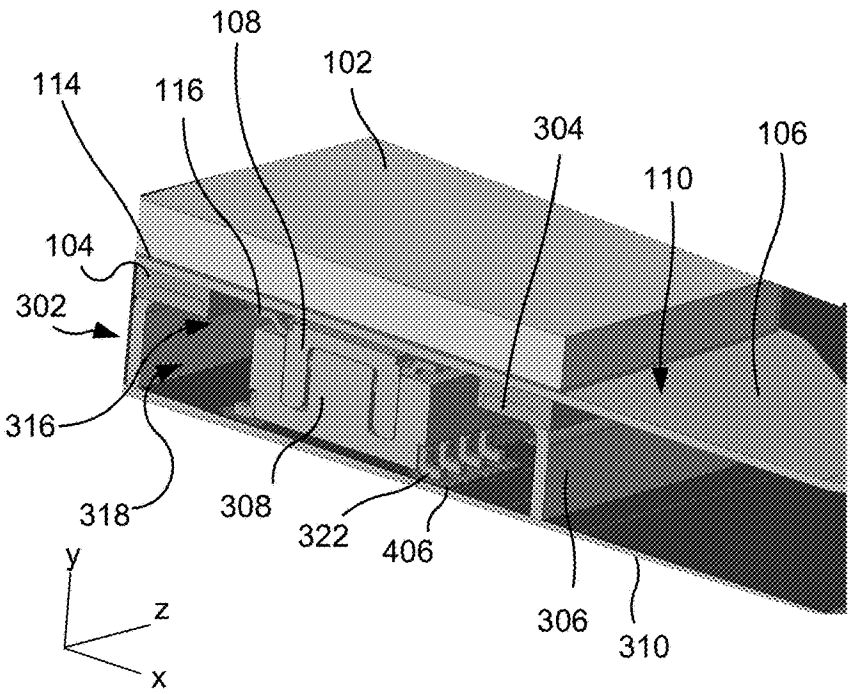
FIG. 5 is a cross-sectional perspective view of an engaged electronic connector assembly corresponding to FIG. 4.

Additionally referring to FIGS. 3, 4, and 5 (while still referring to FIGS. 1 and 2), the first connector member 108 may be sized and/or otherwise configured to engage a second connector member 308 of the receptacle assembly 300. For example, the second connector member 308 may be a female or male connector, whichever is opposite the type of the first connector member 108, such as but not limited to a B2B receptacle. The second connector member 308 may be mounted on a second PCB 310, which may include a second electrical circuit 312 to which the second connector member 308 is electrically connected. For instance, the second connector member 308 may electrically connect to the second electrical circuit 312 through one or more electrically conductive second contact legs 322 that are soldered, surface mounted, or otherwise electrically attached to one or more electrically conductive second contact plates 406 (see FIGS. 4 and 5) on the second PCB 310. The second connector member 308 further includes second electrical contacts 314 that are electrically connected to respective ones of the second contact legs 322 and that are further alignable with corresponding ones of the first electrical contacts 120. For instance, when the first connector member 108 engages/mates with the second connector member 308, the first electrical circuit 122 on the first PCB 106 is electrically connected to the second electrical circuit 312 on the second PCB 310 via the connection established between respective ones of the one or more electrically conductive first contact plates 118 connected to the first electrical contacts 120, which are in removable electrical contact with respective ones of second electrical contacts 314 connected to respective ones of the second contact legs 322 that are connected to respective ones of the one or more electrically conductive second contact plates 314.

The first connector member 108 has a connector body sized and/or otherwise configured to fit within an opening 316 defined by a first set of walls 304 (e.g., a cover or top walls) of an EMI shield frame 302 surrounding the second connector member 308 in the receptacle assembly 300 on the second PCB 310. The EMI shield frame 302 further includes a second set of walls 306 (e.g., side/surrounding walls) defining a space 318 within which the first connector member 108 and the second connector member 308 reside when engaged. For example, in an implementation, the EMI shield frame 302 may be a container having one partially open end and an opposite fully open end, such as but not limited to a 4 sided box. In an aspect, each one of the first set of walls 304 or the second set of walls 306 may only be a single wall or may include multiple walls. In an aspect, the space 318 defined by the second set of walls 306 (and which may be further limited by the first set of walls 304) is a cubic/box-shaped volume. In an aspect, the opening 316 may be defined by inner-facing edges of the first set of walls 304 such that the opening 316 may form a window into the space 318 within the EMI shield frame 302. In an aspect, the first set of walls 304 extend in a first plane (e.g., an x-z plane) that is perpendicular to a second plane (e.g., an x-y plane) in which the second set of walls 306 extend. In an aspect, the first set of walls 304 extend in a first plane (e.g., a first x-z plane) that is parallel to a second plane (e.g., a second x-z plane) in which a body of the second PCB 310 extends. In an aspect, the second set of walls 306 extend in a second plane (e.g., an x-y plane) that is perpendicular to a plane (e.g., an x-z plane) in which the body of the second PCB 310 extends.

In an aspect, the material of the EMI shield frame 302 may be electrically conductive, and the EMI shield frame 302 is soldered or otherwise electrically attached to the second PCB 310 such that the EMI shield frame 302 is electrically connected to a grounded portion of the second PCB 310. In an aspect, the first connector member 108 and the second connector member 308 may be formed from any non-electrically conductive material, or minimally electrically conductive material, such as but not limited to plastics, ceramics, or composites.

In addition to being electrically conductive, the material of the EMI shield frame 302 may also be a magnetically-attractive material, such as a ferrous or soft magnet material, for being magnetically attractable by the permanent magnet 102 attached to the second side 110 of the first PCB 106 opposite the first side 112 of the first PCB 106. The permanent magnet 102 has a magnet body sized to cover the opening 316 defined by the first set of walls 304 of the EMI shield frame 302 of the receptacle assembly 300. The magnet body of the permanent magnet 102 is further sized or otherwise configured or selected to provide a magnetic attraction force between the permanent magnet 102 and the EMI shield frame 302, where the magnetic attraction force acts as a supplemental retention force to increase retention (relative to without the use of the permanent magnet 102) between the first connector member 108 and the second connector member 308 when engaged. In an aspect, the magnet body of the permanent magnet 102 may be sized or otherwise configured to include a magnetic field such that when the EMI shield frame 302 is positioned within such magnetic field, the magnetic field magnetizes the magnetically-attractive material of the EMI shield frame 302. As such, the interaction between the magnetic field of the permanent magnet 102 and the magnetized material of the EMI shield frame 302 results in the magnetic attraction force that acts as a supplemental retention force between the permanent magnet 102 and the EMI shield frame 302.

The magnetic attraction force between the permanent magnet 102 and the EMI shield frame 302 may press the first PCB 106 against an opposing portion of the first set of walls 304 of the EMI shield frame 302, so as to cause a grounded portion 408 (see FIG. 4) on the first side 112 of the first PCB 106 to make an electrical connection with the EMI shield frame 302. For example, the opposing portion of the first set of walls 304 may include an electric contact area, e.g., a top surface. Also, for example, the grounded portion 408 (see FIG. 4) on the first PCB 106 may include, but is not limited to, a contact area such as a grounded ring, which is electrically connected to a ground layer in the first PCB 106. For instance, as an example, the grounded portion 408 (see FIG. 4) may be a stripe of electrically conductive material such as copper, where the stripe forms a ring along a perimeter of the first PCB 106. In an example implementation, the top surface of the first set of walls 304 extends in a first plane (e.g., a first x-z plane) parallel to a second plane (e.g., a second x-z plane) in which a bottom surface, side, or face of the permanent magnet 102 that faces the second side 110 of the first PCB 106 extends and/or in which the grounded portion 408 (see FIG. 4) of the first side 112 of the first PCB 106 extends. In such an engaged configuration, the magnetic attraction force between the permanent magnet 102 and the EMI shield frame 302 is sized to press the first PCB 106 against the contact area defined by the first set of walls 304 of the EMI shield frame 302, so as to cause the grounded portion 408 of the first side 112 of the first PCB 106 to make an electrical connection with such contact area. Therefore, since the EMI shield frame 302 is also electrically connected to a grounded portion of the second PCB 310, electrically connecting the EMI shield frame 302 with the grounded portion 408 (see FIG. 4) on the first side 112 of the first PCB 106 forms an EMI-protected space 318 around the first connector member 108 and the second connector member 308 when engaged.

In aspects where the first PCB 106 is an FPC, the electronic connector assembly 100 may be referred to as an FPC assembly (FPCA). Generally, due to the flexibility of FPCs, a stiffener such as a metal may be mechanically disposed on an outer surface of an FPCA to make the FPCA rigid. However, in some present aspects where the first PCB 106 is an FPC, the permanent magnet 102 may also be configured as a stiffener positioned toward at least a portion of the FPC adjacent to the first connector member 108. Accordingly, in addition to providing a magnetic attraction force that (1) supplements the retention force between the first connector member 108 and the second connector member 308 in an engaged position, and (2) presses the first PCB 106 against the first set of walls 304 of the EMI shield frame 302 so as to define the EMI-protected space as described above, the permanent magnet 102 may also (3) act as a stiffener of at least a portion of the FPC that is adjacent to the electronic contact assembly 100.

Optionally, as mentioned above, the electronic connector assembly 100 may further include the electrically conductive deformable ring 104 affixed to, and electrically connected to, the grounded portion 408 (see FIG. 4) of the first side 112 of the first PCB 106. For example, the electrically conductive deformable ring 104 may be made from a foam, an electrically conductive putty, an electrically conductive mesh, or any other electrically conductive and at least partially deformable or at least partially compressible or at least partially elastic material.

In this aspect, when the first connector member 108 engages the second connector member 308, the magnetic attraction force between the permanent magnet 102 and the EMI shield frame 302 may be sufficient to compress the electrically conductive deformable ring 104 between the first PCB 106 and the first set of walls 304 of the EMI shield frame 302. By causing or increasing (e.g., relative to without use of the permanent magnet 102) compression of the electrically conductive deformable ring 104, the permanent magnet 102 cause an improvement in the electrical connection between the grounded portion 408 of the first side 112 of the first PCB 106 and the EMI shield frame 302, such as by increasing the number of contact points or the contact area, as described below.

In other words, for example, the magnetic attraction force between the permanent magnet 102 and the EMI shield frame 302 combined with the elasticity or deformability of the electrically conductive deformable ring 104 may in some cases cause the ring 104 to elastically deform at its the top and bottom surfaces. Such deformation may increase contact points and/or contact areas with corresponding surfaces of the grounded portion 408 of the first side 112 of the first PCB 106 and top side or face of the first set of walls 304 of the EMI shield frame 302, thereby increasing electrical connectivity.

For instance, compressing the conductive deformable ring 104 between the first PCB 106 and the first set of walls 304 of the EMI shield frame 302 reduces an electrical contact resistance between the grounded portion 408 of the first side 112 of the first PCB 106 and the EMI shield frame 302 (e.g., relative to without use of the permanent magnet 102 and the conductive deformable ring 104). For example, the permanent magnet 102 may be a relatively strong magnet, such as a Neodymium n52 grade magnet, that provides a compression force configured to sufficiently reduce the electrical contact resistance between the grounded portion 408 (see FIG. 4) of the first side 112 of the first PCB 106 and the EMI shield frame 302. Such improvement of the electrical connection between the grounded portion 408 of the first side 112 of the first PCB 106 and the EMI shield frame 302 improves the EMI shielding in the EMI-protected space described above.

In an aspect, for example, the size of the magnetic attraction force between the permanent magnet 102 and the EMI shield frame 302 may be configured to compress a thickness of the conductive deformable ring 104 by at least 30%, and at most 90%. In an aspect, the size of the magnetic attraction force between the permanent magnet 102 and the EMI shield frame 302 may be at least equal to an elastic force, e.g., a compression resistance force, of the conductive deformable ring 104.

In an aspect, the EMI shield frame 302 is made of stainless steel. For example, in an aspect, the EMI shield frame 302 is made of a 303 grade steel or a higher grade steel. For example, in an aspect, the EMI shield frame 302 may be made of a 1010 grade steel.

In an aspect, an adhesive may be used to connect the permanent magnet 102 to the second side 110 of the first PCB 106. In these aspects, the electronic connector assembly 100 may include the adhesive layer 114 between the permanent magnet 102 and the second side 110 of the first PCB 106. In an aspect, the adhesive layer 114 includes Pressure Sensitive Adhesive (PSA).

In an aspect, a grounded portion of the second side 110 of the first PCB 106 may make an electrical connection with the permanent magnet 102.

In an aspect, if the permanent magnet 102 is large enough and/or the magnetic attraction force between the permanent magnet 102 and the EMI shield frame 302 is sufficiently strong, the conductive deformable ring 104 may not be necessary, and instead one or more electrically conductive spring fingers 320 (see FIG. 3) may be formed on the first set of walls 304 of the EMI shield frame 302 to contact the grounded portion 408 of the first side 112 of the first PCB 106 directly. Specifically, in an aspect, the one or more electrically conductive spring fingers 320 may be assembled on and electrically connected to the first set of walls 304 of the EMI shield frame 302. The magnet body of the permanent magnet 102 may be further positioned to provide the magnetic attraction force between the permanent magnet 102 and the EMI shield frame 302 to press the first PCB 106 against the one or more electrically conductive spring fingers 320 (see FIG. 3) and cause the grounded portion 408 of the first side 112 of the first PCB 106 to make the electrical connection with the EMI shield frame 302 through the one or more electrically conductive spring fingers 320 (see FIG. 3).

In some implementations, the apparatus of the present disclosure may be in the form of a kit of parts that can be assembled to form the apparatus. For instance, in an aspect an electronic connector kit is provided. The electronic connector kit includes an electronic connector assembly including a first PCB having a first electrical circuit; a first connector member configured to be mounted on a first side of the first PCB and to be electrically connected to the first electrical circuit; and a permanent magnet attachable on a second side of the first PCB opposite the first side. The electronic connector kit further includes a receptacle assembly including a second PCB; an EMI shield frame configured to be mounted on the second PCB and to be electrically connected to a grounded portion of the second PCB; and a second connector member configured to be mounted to the second PCB within the EMI shield frame and to be electrically connected to a second electrical circuit on the second PCB. The second connector member is configured to engage the first connector member to connect the first electrical circuit with the second electrical circuit. The first connector member has a connector body sized to fit within an opening defined by walls of the EMI shield frame. The EMI shield frame includes a magnetically-attractive material; and the permanent magnet has a magnet body sized to cover the opening in the EMI shield frame and to provide a magnetic attraction force between the permanent magnet and the EMI shield frame to press the first PCB against an opposing portion of the walls of the EMI shield frame and cause a grounded portion of the first side of the first PCB to make an electrical connection with the EMI shield frame.

Thus, the described electronic connector may be used for connecting a PCB, such as an FPC, to another circuit board, such as another PCB, e.g., a mother board of a computing device. The electronic connector in an aspect includes a permanent magnet affixed on an outer surface of the FPC and magnetically attractive to an EMI shield frame that is soldered to another electronic board. The permanent magnet is sized to cause a magnetic attraction force between the permanent magnet and the EMI shield frame to improve the retention between a male and female portion of the electronic connector when in an engaged configuration. The magnetic attraction force is further sized to press the PCB against the EMI shield frame such that a ground of the PCB is electrically connected to a the EMI shield frame to create an EMI-protected space. The permanent magnet may further act as a stiffener of at least a portion of the PCB. Accordingly, a more cost-effective and space-effective electronic connector is provided that can also be dis-assembled and re-assembled without damaging the EMI shielding mechanism of the electronic connector.

Figure 6:
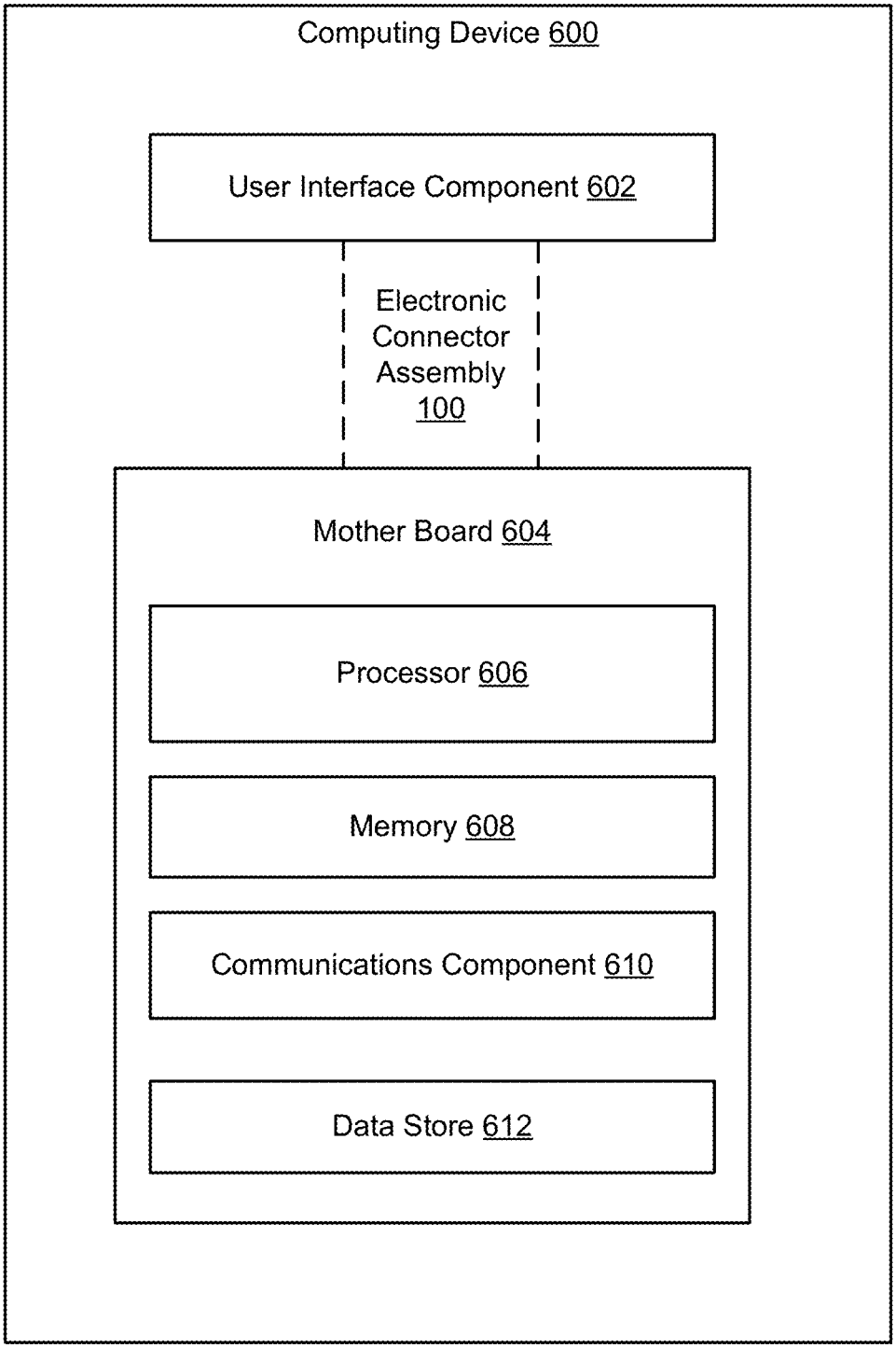
FIG. 6 is a block diagram of an example computing device that implements the example electronic connector assembly of FIGS. 1-4.

FIG. 6 illustrates an example application of the electronic connector assembly 100 in an example computing device 600 that includes a mother board 604 and a user interface component 602, such as a PCB of a display, where the electronic connector assembly 100 electrically connects at least one electrical circuit in the user interface component 602 with at least one electrical circuit in the mother board 604. It should be understood that this is a non-limiting example, and that electronic connector assembly 100 may be used to connect two electrical components of any type. In an aspect, for example, the EMI shielding apparatus and functionality described herein may prevent EMI interference caused by the electronic connector assembly 100 from interfering with a communications component 610, e.g., a modem, of the example computing device 600, specifically when the communications component 610 communicates wirelessly. Although it should be understood that the EMI shielding may be used to reduce interference with any other electrical signals within the computing device 600 or outside the computing device 600.

In an example, the mother board 604 includes a processor 606, and the processor 606 may include a single or multiple set of processors or multi-core processors. Moreover, the processor 606 may be implemented as an integrated processing system and/or a distributed processing system. The mother board 604 may further include memory 608, such as for storing local versions of applications being executed by the processor 606, related instructions, parameters, etc. The memory 608 may include a type of memory usable by a computer, such as random access memory (RAM), read only memory (ROM), tapes, magnetic discs, optical discs, volatile memory, non-volatile memory, and any combination thereof. Additionally, the processor 606 and the memory 608 may include and execute an operating system executing on the processor 606, one or more applications, display drivers, etc., and/or other components of the computing device 600.

Further, the mother board 604 may include a communications component 610 that provides for establishing and maintaining communications with one or more other devices, parties, entities, etc. utilizing hardware, software, and services. The communications component 610 may carry communications between components on the computing device 600, as well as between the computing device 600 and external devices, such as devices located across a communications network and/or devices serially or locally connected to the computing device 600. For example, the communications component 610 may include one or more buses, and may further include transmit chain components and receive chain components associated with a wireless or wired transmitter and receiver, respectively, operable for interfacing with external devices.

Additionally, the mother board 604 may include a data store 612, which can be any suitable combination of hardware and/or software, that provides for mass storage of information, databases, and programs. For example, a data store 612 may be or may include a data repository for applications and/or related parameters not currently being executed by processor 606. In addition, the data store 612 may be a data repository for an operating system, application, display driver, etc., executing on the processor 606, and/or one or more other components of the computing device 600.

The computing device 600 may also include a user interface component 602 operable to receive inputs from a user of the computing device 600 and further operable to generate outputs for presentation to the user (e.g., via a display interface to a display device). The user interface component 602 may include one or more input devices, including but not limited to a keyboard, a number pad, a mouse, a touch-sensitive display, a navigation key, a function key, a microphone, a voice recognition component, or any other mechanism capable of receiving an input from a user, or any combination thereof. Further, the user interface component 602 may include one or more output devices, including but not limited to a display interface, a speaker, a haptic feedback mechanism, a printer, any other mechanism capable of presenting an output to a user, or any combination thereof.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. An electronic connector assembly, comprising:

a first printed circuit board (PCB) including a first electrical circuit;

a first connector member disposed on a first side of the first PCB and electrically connected to the first electrical circuit, the first connector member having a connector body sized and configured to engageably fit within an opening defined and completely surrounded by walls of an electromagnetic interference (EMI) shield frame of a receptacle assembly having a second connector member engageable with the first connector member, the EMI shield frame comprising a magnetically-attractive material; and a permanent magnet disposed on a second side of the first PCB opposite the first side, the permanent magnet having a magnet body sized and configured to completely cover an area substantially equal to the opening defined and completely surrounded by the walls of the EMI shield frame of the receptacle assembly, wherein the magnet body is sized and configured to provide a magnetic attraction force between the permanent magnet and the EMI shield frame to press the first PCB against an opposing portion of the walls of the EMI shield frame and cause a grounded portion of the first side of the first PCB to make an electrical connection with the EMI shield frame during an engagement of the first connector member of the electronic connector assembly with the second connector member of the receptacle assembly.

2. The electronic connector assembly of claim 1, wherein the permanent magnet comprises a bottom side extending in a first plane and facing the second side of the first PCB, wherein the walls of the EMI shield frame include a first set of walls defining the opening and a second set of walls defining an EMI-protected space, wherein the first set of walls define an electric contact area extending in a second plane parallel to the first plane.

3. The electronic connector assembly of claim 1, wherein the first PCB comprises a Flexible Printed Circuit (FPC).

4. The electronic connector assembly of claim 3, wherein the permanent magnet is configured as a stiffener positioned toward at least a portion of the FPC that is adjacent to the first connector member.

5. The electronic connector assembly of claim 1, wherein the first connector member comprises a Board-to-Board (B2B) plug and the second connector member comprises a B2B receptacle, wherein the B2B receptacle is electrically connected to a second electrical circuit on a second PCB, wherein the EMI shield frame is connected to a grounded portion of the second PCB.

6. The electronic connector assembly of claim 5, wherein the magnetic attraction force is sized to generate a supplemental retention force between the B2B plug and the B2B receptacle.

7. The electronic connector assembly of claim 1, further comprising an electrically conductive deformable ring affixed to the first side of the first PCB and electrically connected to the grounded portion of the first side of the first PCB.

8. The electronic connector assembly of claim 7, further comprising the receptacle assembly.

9. The electronic connector assembly of claim 8, wherein the EMI shield frame is disposed on a second PCB and electrically connected to a grounded portion of the second PCB, wherein the second connector member is electrically connected to a second electrical circuit on the second PCB, wherein the second connector member is configured to engage the first connector member to electrically connect the second electrical circuit with the first electrical circuit, wherein, in an engaged state of the first connector member and the second connector member, the magnetic attraction force between the permanent magnet and the EMI shield frame is configured to compress the conductive deformable ring between the first side of the first PCB and the walls of the EMI shield frame to improve the electrical connection between the grounded portion of the first side of the first PCB and the EMI shield frame.

10. The electronic connector assembly of claim 7, wherein the size of the magnetic attraction force between the permanent magnet and the EMI shield frame is configured to compress a thickness of the conductive deformable ring at least by 30% and at most by 90%.

11. The electronic connector assembly of claim 7, wherein the size of the magnetic attraction force between the permanent magnet and the EMI shield frame is at least equal to a compression resistance force of the conductive deformable ring.

12. The electronic connector assembly of claim 1, further comprising one or more electrically conductive spring fingers assembled on and electrically connected to the walls of the EMI shield frame, wherein the magnet body is further positioned to provide the magnetic attraction force between the permanent magnet and the EMI shield frame to press the first PCB against the one or more electrically conductive spring fingers and cause the grounded portion of the first side of the first PCB to make the electrical connection with the EMI shield frame through the one or more electrically conductive spring fingers.

13. An electronic connector, comprising:

an electronic connector assembly including a first printed circuit board (PCB) having a first electrical circuit, a first connector member disposed on a first side of the first PCB and electrically connected to the first electrical circuit, and a permanent magnet disposed on a second side of the first PCB opposite the first side; and a receptacle assembly comprising an electromagnetic interference (EMI) shield frame disposed on a second PCB and electrically connected to a grounded portion of the second PCB, and a second connector member mounted to the second PCB within the EMI shield frame and electrically connected to a second electrical circuit on the second PCB, wherein the second connector member is configured to engage the first connector member to connect the first electrical circuit with the second electrical circuit, wherein the first connector member has a connector body sized to fit within an opening defined by walls of the EMI shield frame, wherein the EMI shield frame comprises a magnetically-attractive material, wherein the permanent magnet has a magnet body sized to cover the opening in the EMI shield frame and to provide a magnetic attraction force between the permanent magnet and the EMI shield frame to press the first PCB against an opposing portion of the walls of the EMI shield frame and cause a grounded portion of the first side of the first PCB to make an electrical connection with the EMI shield frame.

14. The electronic connector of claim 13, wherein the electronic connector assembly further comprises an electrically conductive deformable ring affixed to the first side of the first PCB and electrically connected to the grounded portion of the first side of the first PCB, wherein, in an engaged state of the first connector member and the second connector member, the magnetic attraction force between the permanent magnet and the EMI shield frame is configured to compress the conductive deformable ring between the first side of the first PCB and the walls of the EMI shield frame to improve the electrical connection between the grounded portion of the first side of the first PCB and the EMI shield frame.

15. The electronic connector of claim 13, wherein the permanent magnet comprises a bottom side extending in a first plane and facing the second side of the first PCB, wherein the walls of the EMI shield frame include a first set of walls defining the opening and a second set of walls defining an EMI-protected space, wherein the first set of walls define an electric contact area extending in a second plane parallel to the first plane.

16. The electronic connector of claim 13, wherein the magnetic attraction force is sized to generate a supplemental retention force between the first connector member and the second connector member.

17. An electronic connector kit, comprising:

an electronic connector assembly including:

a first printed circuit board (PCB) having a first electrical circuit;

a first connector member configured to be mounted on a first side of the first PCB and to be electrically connected to the first electrical circuit; and a permanent magnet attachable on a second side of the first PCB opposite the first side; and a receptacle assembly including:

a second PCB;

an electromagnetic interference (EMI) shield frame configured to be mounted on the second PCB and to be electrically connected to a grounded portion of the second PCB; and a second connector member configured to be mounted to the second PCB within the EMI shield frame and to be electrically connected to a second electrical circuit on the second PCB, wherein the second connector member is configured to engage the first connector member to connect the first electrical circuit with the second electrical circuit;

wherein the first connector member has a connector body sized to fit within an opening defined by walls of the EMI shield frame;

wherein the EMI shield frame comprises a magnetically-attractive material; and wherein the permanent magnet has a magnet body sized to cover the opening in the EMI shield frame and to provide a magnetic attraction force between the permanent magnet and the EMI shield frame to press the first PCB against an opposing portion of the walls of the EMI shield frame and cause a grounded portion of the first side of the first PCB to make an electrical connection with the EMI shield frame.

18. The electronic connector kit of claim 17, wherein the electronic connector assembly further comprises an electrically conductive deformable ring configured to be affixed to the first side of the first PCB and to be electrically connected to the grounded portion of the first side of the first PCB, wherein, in an engaged state of the first connector member and the second connector member, the magnetic attraction force between the permanent magnet and the EMI shield frame is configured to compress the conductive deformable ring between the first side of the first PCB and the walls of the EMI shield frame to increase the electrical connection between the grounded portion of the first side of the first PCB and the EMI shield frame.

19. The electronic connector kit of claim 17, wherein the permanent magnet comprises a bottom side extending in a first plane and facing the second side of the first PCB, wherein the walls of the EMI shield frame include a first set of walls defining the opening and a second set of walls defining an EMI-protected space, wherein the first set of walls define an electric contact area extending in a second plane parallel to the first plane.

20. The electronic connector of claim 17, wherein the magnetic attraction force is sized to generate a supplemental retention force between the first connector member and the second connector member.

* * * * *